US007052646B2

(12) United States Patent
Ericksson et al.

(10) Patent No.: US 7,052,646 B2
(45) Date of Patent: May 30, 2006

(54) IGNITER FOR OXYGEN LANCE FOR THERMAL CUTTING, DRILLING ETC.

(75) Inventors: Borje Ericksson, Karlskoga (SE); Lennart Eriksson, Karlskoga (SE)

(73) Assignee: Ferrox AB, Grythyttan (SE)

( * ) Notice: Subject to any disclaimer, the term of this patent is extended or adjusted under 35 U.S.C. 154(b) by 109 days.

(21) Appl. No.: 10/451,263

(22) PCT Filed: Dec. 17, 2001

(86) PCT No.: PCT/SE01/02793

§ 371 (c)(1),
(2), (4) Date: Sep. 23, 2003

(87) PCT Pub. No.: WO02/50396

PCT Pub. Date: Jun. 27, 2002

(65) Prior Publication Data

US 2005/0029717 A1 Feb. 10, 2005

(30) Foreign Application Priority Data

Dec. 21, 2000 (SE) ..... 0004743

(51) Int. Cl.
*B23K 7/00* (2006.01)

(52) U.S. Cl. ..... 266/48; 148/196

(58) Field of Classification Search ..... 266/48; 148/194, 196

See application file for complete search history.

(56) References Cited

U.S. PATENT DOCUMENTS

| | | | | |
|---|---|---|---|---|
| 1,965,275 | A | | 7/1934 | Aronson |
| 2,634,196 | A | | 4/1953 | Pennecot |
| 3,275,484 | A | | 9/1966 | Foote et al. |
| 4,170,941 | A | * | 10/1979 | Reichard et al. ..... 102/202 |
| 4,423,855 | A | | 1/1984 | Kallenbach |
| 5,069,616 | A | | 12/1991 | Larsson |
| 5,580,515 | A | | 12/1996 | Petrovich |
| 5,622,672 | A | | 4/1997 | Swick et al. |
| 5,622,678 | A | | 4/1997 | Hiltawsky |

FOREIGN PATENT DOCUMENTS

| | | | |
|---|---|---|---|
| FR | 2529495 | A * | 1/1984 |
| RU | 2090323 | | 9/1997 |
| RU | 2104131 | | 2/1998 |
| SU | 149297 | | 12/1961 |
| SU | 889329 | | 12/1981 |

* cited by examiner

*Primary Examiner*—Scott Kastler
(74) *Attorney, Agent, or Firm*—Connolly Bove Lodge & Hutz LLP; Larry J. Hume

(57) ABSTRACT

In accordance with the method and the device according to the invention, previous pure pyrotechnic primers for initiating the ignition charges (6*a*, 6*b*) of the oxygen lance igniters (13) are replaced by a small quantity of powdered zirconium (7). Zirconium is pyrophoric and therefore ignites, providing it has a sufficiently large surface area, in the presence of a sufficient quantity of pure oxygen, although in ordinary air it is no more flammable than ordinary wood.

14 Claims, 4 Drawing Sheets

IGNITER FOR OXYGEN LANCE FOR THERMAL CUTTING, DRILLING ETC.

The present invention relates to a new method of starting up and igniting oxygen lances mainly of the type which work without a supplementary electric arc. The invention also relates to an igniter which works in accordance with said method. A particular advantage of the method and the device (the igniter) according to the invention is that it can be used both in the air and under water.

Oxygen lances of the type concerned here, which are used mainly for thermal cutting and drilling, and moreover under water, in scrap yards and also within the steel industry, exist in two basic types in principle, the first of which and the type mainly concerned here works with only oxygen and therefore requires some type of separate ignition function, while the second main type works with oxygen and its own supplementary electric arc.

One problem which oxygen lances which do not have their own arc have hitherto suffered from is that they have always been difficult to ignite. In oxygen lances which have their own arc, the arc is used for igniting the lance. There is also a variant in between, in which a separate electric arc igniter is used for igniting the lance, which is then used completely separately from the igniter as this is no longer required after ignition.

The difficulty of igniting oxygen lances without access to an electric arc resides in the fact that the lance tip must be heated up in another way to the ignition temperature of the iron, that is to say around 1050° C. Use has previously been made of a number of different methods as far as starting up oxygen lances without access to electric arcs is concerned, and probably the two oldest methods are with an ordinary gas welding torch or with a coal fire. However, neither of these methods has been especially popular, because the person starting the lance is then compelled to remain very close to the mouth of the lance and, if he should happen to move too close to it, he may be struck by molten iron spray.

A somewhat more refined device or igniter for igniting oxygen lances which do not have access to their own electric arc is described in SE 7605274-5. The igniter described therein consists of a sleeve, open at one of its ends, of greater cross-sectional diameter than the mouth of the lance. The sleeve is intended to be slipped over the mouth of the lance and retained there by a spring adapted for the purpose. The sleeve itself is then at least partly filled with a metal powder and also a primer which can be ignited via an ignition duct from the otherwise closed end of the sleeve. It emerges from the description that it is to be possible to ignite the primer either by means of a notch-sensitive composition arranged immediately outside the closed end of the sleeve or by virtue of the ignition duct containing chemicals which themselves ignite above the ambient temperature, so that it is possible to ignite the igniter by means of a small temperature increase. It is also indicated in the text that the igniter could contain pyrophoric substances, that is to say those which ignite when oxygen is supplied, and in that case that these would be added to the ignition composition or primer and in this way bring about auto-ignition when the oxygen supply is opened. However, the text contains no proposals for suitable pyrophoric substances which could be used for this purpose. In quite general terms, it could probably be said that to the extent that the igniter described in this patent contains such "chemicals which themselves ignite above the ambient temperature, so that it is possible to ignite by means of a small temperature increase", the igniter in question appears not to be capable of meeting necessary safety requirements because in that case it must have a strong tendency towards accidental ignition.

Another similar ignition device for oxygen lances is described in printed Swedish patent application 8704421-0, in which it is stated that the combustion powder, that is to say the powder charge which serves for the actual heating up to the ignition temperature of the lance, is suitably to consist of aluminium powder and that the surrounding sleeve is to be provided with a stop which regulates how far the lance can be inserted into the sleeve, and also that the latter can also contain a stop mass consisting of, for example, cotton, and also that it is possible to arrange a pyrotechnic delay between a fuse head arranged at the mainly closed end of the sleeve and the primer arranged inside the sleeve, which is therefore in its turn to ignite the combustion powder. This arrangement is in order that the person igniting the outer primer will be able to get out of the way. In other respects, the same comments apply as for the device described previously, namely that, as it has to contain not inconsiderable quantities of pyrotechnic material, the special provisions applying for such material must also apply for these igniters.

Oxygen lance igniters of the general type described in the abovementioned patent specifications, with pyrotechnic charges as the start-up medium, have been available on the market for a number of years, and they have in practical use been found to have a rather high failure rate and have required no little instinctive feeling on the part of the person handling the lance with regard to knowing how rapidly to increase the oxygen supply to full capacity.

The present invention relates then to a new type of oxygen lance igniter which is started up only by means of the oxygen application and which does not contain any pyrotechnic primer and therefore does not have to be dependent on any special safety regulations.

This is because, in accordance with the method and the device according to the invention, previous pure pyrotechnic primers for initiating the ignition charges (the combustion powder) of the oxygen lance igniters are replaced by a small quantity of pyrophoric metal powder such as zirconium or titanium. Theoretically, phosphorus which is clearly pyrophoric could also function, but phosphorus ignites in air and is therefore difficult to handle under normal conditions and therefore unsuitable in this context. Zirconium on the other hand, which is the best alternative in our opinion, is pyrophoric and ignites at high oxygen contents on condition that it has a sufficiently large surface area, but is no more flammable than ordinary wood in air, where the oxygen content is normally slightly more than 20%. It is also pertinent that oxygen lances of the type concerned here are supplied with either completely pure oxygen or oxygen mixed with small quantities of inert gas, for example roughly 5% argon, and the oxygen concentrations are more than adequate to ignite zirconium or titanium powder with a sufficiently large active surface area.

The oxygen lance igniter characteristic of the invention can therefore quite generally be said to consist of an ignition charge consisting of metal powder (combustion powder) which is enclosed in a sleeve, closed at one end, with an inner diameter which is greater than the outer diameter of the oxygen lance, this sleeve being intended, when the lance is to be started up, to be slipped over the mouth of the lance until it reaches a certain specific depth, and an initiating charge of powdered pyrophoric metal such as zirconium or titanium also being arranged in this sleeve, in addition to the ignition charge of metal powder, on top of this ignition charge, that is to say at the end facing the oxygen lance. It is not large quantities of pyrophoric metal which are required for this purpose either. If zirconium, the best alternative in our opinion, is selected, roughly 0.05–0.5 g fine-grained pure zirconium with a particle size of 2–6 im is required for this purpose. The initiating charge rapidly ignites the ignition charge used by us in the form of 11 to 15 g of an iron/aluminium powder mixture, in which the components iron and aluminium are present in the weight ratio 1:1. We were also able to establish that this ignition charge is most effective if it comprises a more fine-grained first part charge and a somewhat more coarse-grained second part charge. Half the weight of a first part charge produced by us of roughly 4.0 g therefore consists of aluminium powder with a particle size of roughly 0.1 mm, and the other half of its weight consists of iron powder with a particle size of roughly 0.01 mm, while the second part charge consisted of 4.5 g aluminium pellets with a particle size of 1–3 mm and 4.5 g iron filings with a particle size of 0.4–0.8 mm.

With the oxygen lance igniter characteristic of the invention, it has now been possible to make the start-up of any type of oxygen lance not provided with an arc as easy as should on the whole be possible. As the oxygen lance igniter does not contain any pure pyrotechnics, no special storage restrictions are required either. When the oxygen lance igniter is started up, the oxygen lance igniter is merely positioned in the place intended for it over the mouth of the lance, after which the oxygen is turned on, the high oxygen content resulting in the pyrophoric initiating charge in the form of, for example, metallic pure powdered zirconium igniting and in turn igniting the ignition charge consisting of iron/aluminium powder, which in turn starts up the oxygen/iron combustion and ignites the lance. The reliable start-up of any oxygen lance which is achieved in this way is of course to some extent a consequence of the high combustion temperature of the zirconium of roughly 4900° C.

In addition to the basic idea of using a pyrophoric metal powder such as zirconium or titanium for the purpose concerned here, the invention also includes a detailed design of the oxygen lance igniter itself. In the first place, a pyrophoric metal powder such as zirconium or titanium is required, and it must be held in position at the same time as a sufficiently large surface area of it must be directly available for contact with the oxygen when this is turned on. According to the invention, we meet these requirements by placing the pyrophoric metal powder in a gas-permeable, preferably combustible container directly on top of the ignition charge. As the material for this container, we use ordinary machine felt, from which we form a cup or container with a separate cover of its own and an inner volume which considerably exceeds the minimum volume which would be required for the pyrophoric metal powder. In reality, we have found that it is advantageous if the greater part of the pyrophoric metal powder quite simply forms a powder coating on the inside of the felt container. In this way, we can utilize the large powder surface area which is in this way made available for direct contact with the oxygen. Directly below this felt container, the actual ignition charge is then arranged, preferably in the form of a more fine-grained first part mixture of iron/aluminium powder and a second more coarse-grained mixture of the same metals, in which connection these part mixtures can be the same size in terms of weight. We have also found that there is no reason specially to separate the two part mixtures from one another but that it is entirely satisfactory if these are filled one after the other into their common space in the igniter. On the contrary, it can even be a certain advantage if limited mixing takes place in the boundary layer between the two part mixtures.

The invention has been defined in all its features in the patent claims below, and it will now be described in only somewhat greater detail with reference to a representative design of the same shown in the accompanying figures, in which FIG. 1 shows a sectional inclined projection of an igniter;

Corresponding components have been given the same reference numbers in the different figures irrespective of how and on what scale they are illustrated.

Figure 1:
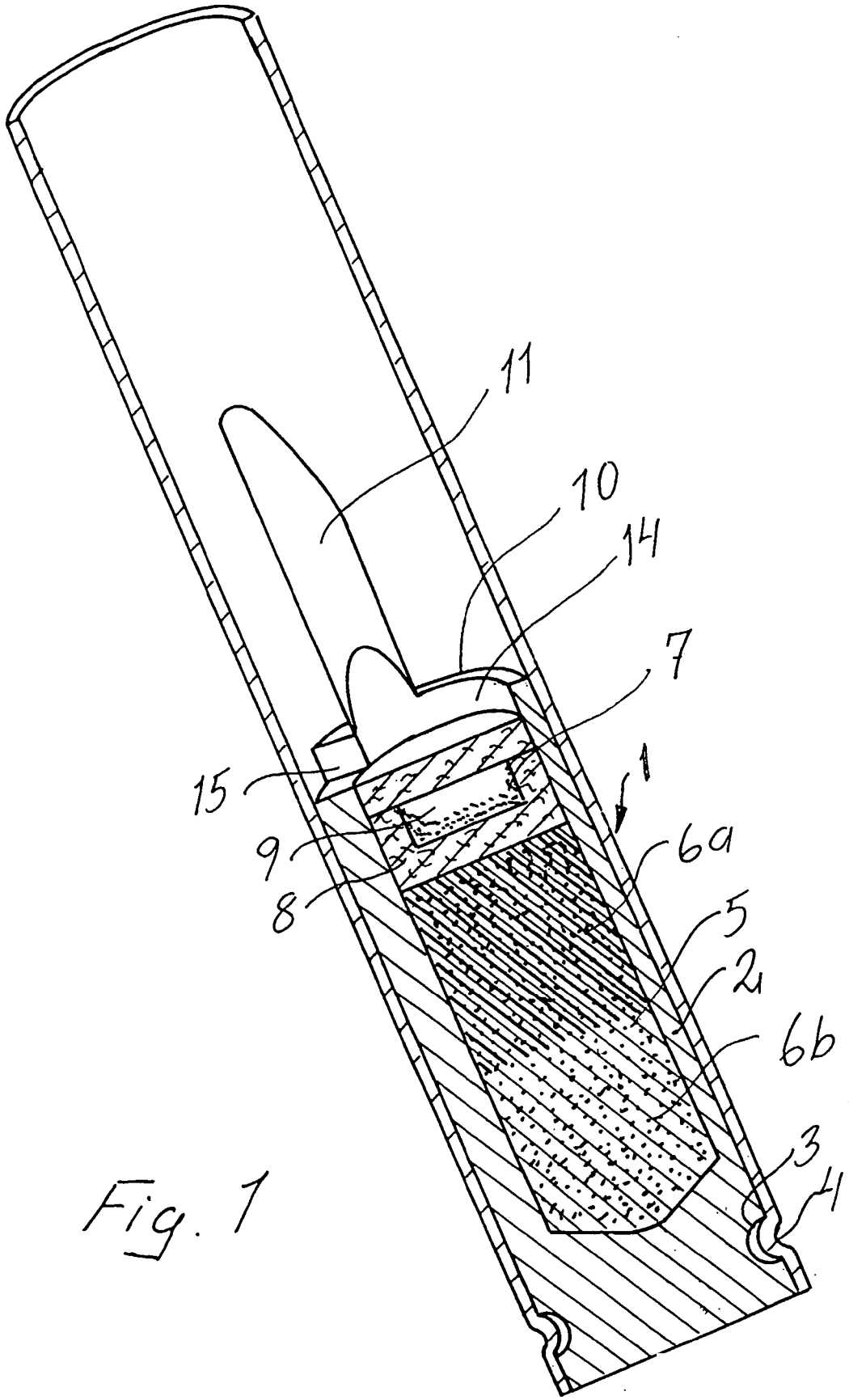
Figure 2:
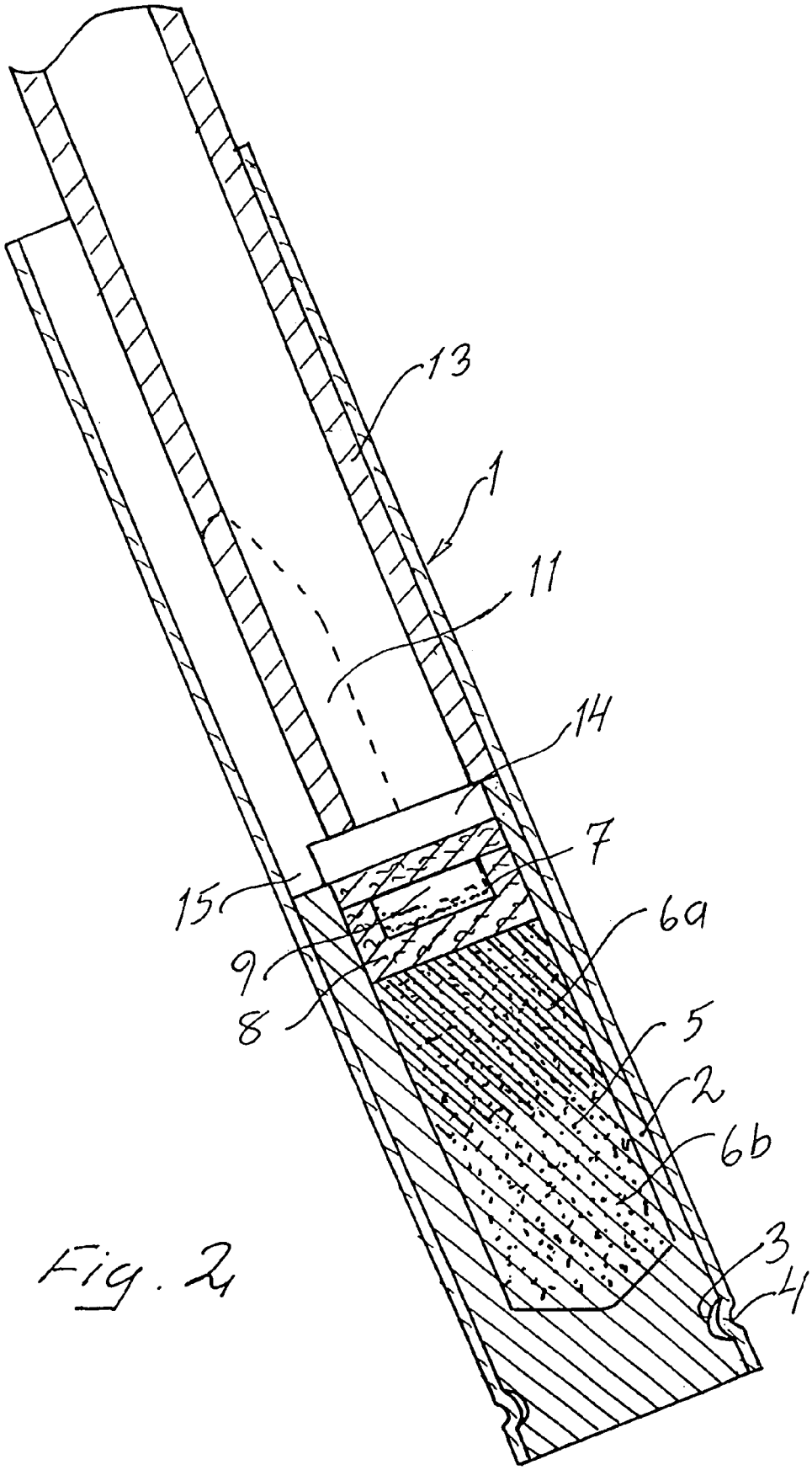
FIG. 2 shows a sectional view of an igniter placed over the lance tip on an oxygen lance which is to be ignited.
Figure 3:
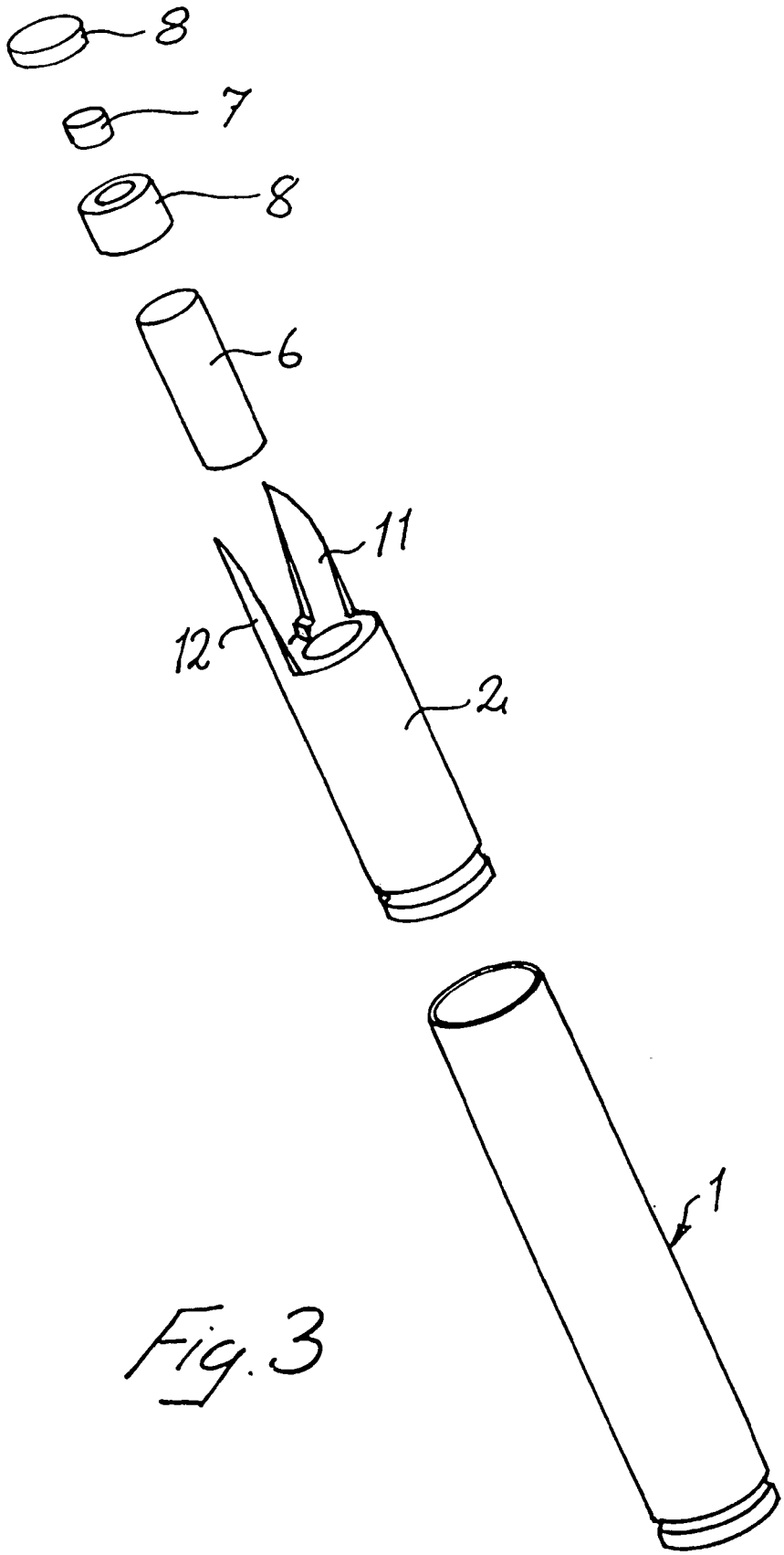
FIG. 3 shows the various component parts of an igniter in an inclined projection and on smaller scale.

As can be seen from FIGS. 1–3, the outer part of the lance igniter according to the invention consists of an outer tube 1 and an inner sleeve 2 which is fixed in the outer tube 1 by means of an upset indentation 4, preferably extending all the way round, accommodated in a groove 3 in the sleeve 2. The inner sleeve 2 is also provided with an inner boring 5 in which two part charges consisting of mixtures of iron/aluminium powder of different particle size are arranged. In the figure, the more fine-grained part charge has the reference 6*a* and the more coarse-grained part charge has the reference 6*b*. Together, these constitute the actual ignition charge, but, in order to set this going, the initiating charge characteristic of the invention is required, which therefore consists of roughly 0.15 g finely divided zirconium 7 arranged in a gas-permeable container or cup 8 provided with a cover and, in the example shown, made from machine felt. The inner space 9 of the cup 8 is considerably greater than the volume of the zirconium powder 7 itself, and the powder lies freely in the space where it forms what could be described as a powder coating of the inner walls of the space 9. The inner sleeve 2 is also provided with a stop edge 10, the function of which is, as shown in FIG. 2, to ensure that the oxygen lance designated by 13 can be guided into this stop position but no further. The inner sleeve 2 is also provided with two preferably somewhat resilient guide tongues 11 and 12 (see FIG. 3), the function of which is, as can be seen from FIG. 2, to guide the mouth of the lance 13 in eccentrically along one inner edge of the tube 1 and also to retain it in this position during handling before ignition. By virtue of the positioning of the stop edge 10 between the outer end of the lance 13 and the cover of the cup 8, a gap space 14 is formed between the cover and the mouth of the lance, and this gap space is also provided with an outlet 15 located between the guide tongues 11 and 12, and this is the way the oxygen can pass through during the initial stage of the ignition process, then passing back through on the outside of the lance.

In order to ignite the lance, it is therefore necessary for the igniter to be slipped onto the mouth of the lance into the stop position shown in FIG. 2, after which the oxygen is turned on in the lance. What happens then is that the greater part of the oxygen follows the gap 14 and leaves through the outlet 15 at the same time as some of the gas flows through the felt cover of the cup 8 and reacts with the zirconium powder which ignites and in turn ignites the ignition charge 6 which ignites the oxygen/iron reaction, and the lance is ready for use.

Figure 4:
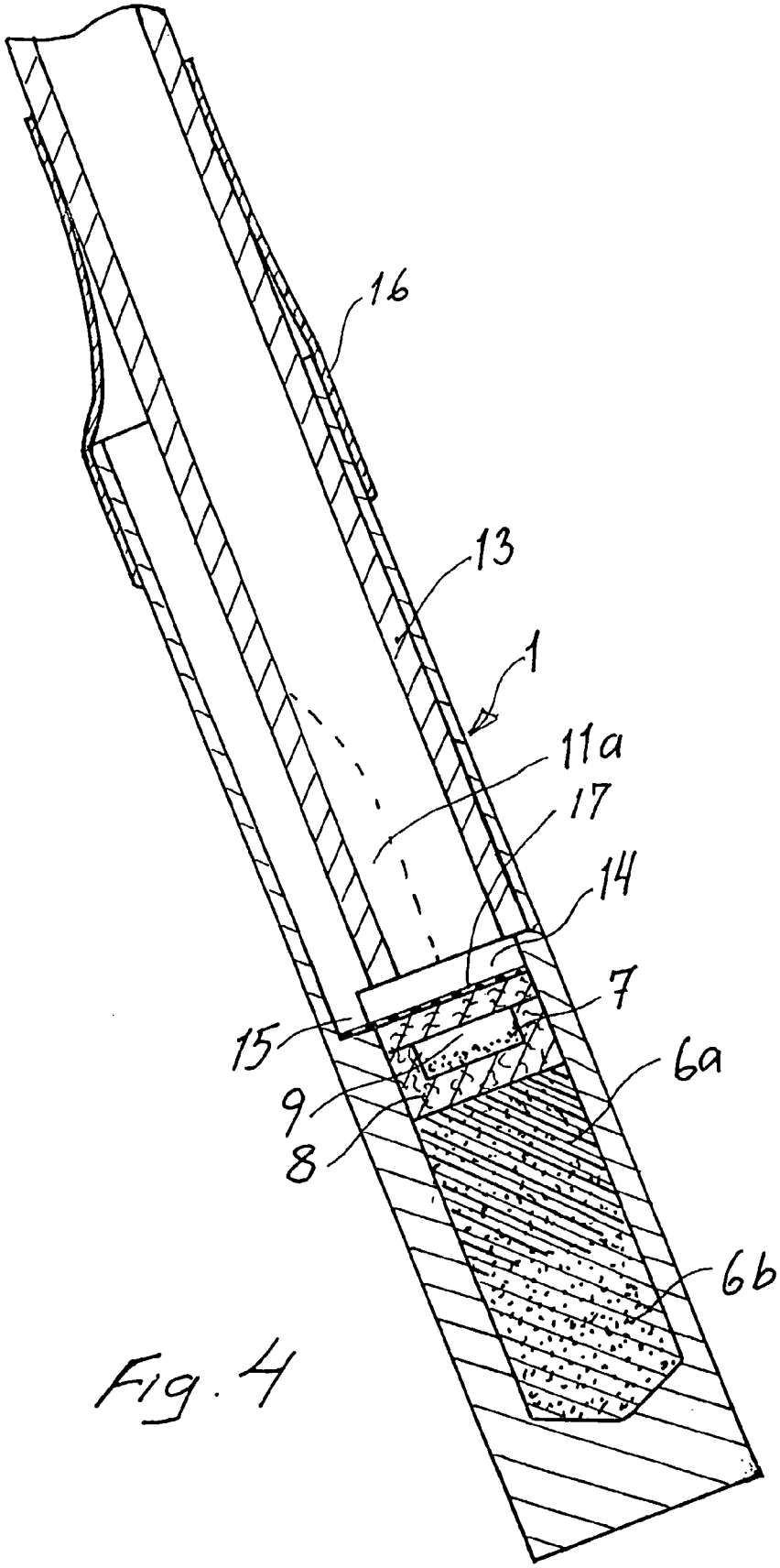
FIG. 4 shows a sectional view of an igniter intended for underwater use mounted on a lance tip intended therefor.

The variant shown in FIG. 4 of the igniter according to the invention has an outer casing 1*a* in which the tube 1 and the sleeve 2 from the variant shown in FIGS. 1–3 have been combined into a unit. In this unit 1*a*, the guide tongues 11 and 12 have been replaced by firm guide projections designated here by 11*a*. The igniter is also adapted for underwater use and is therefore provided with an elastic sealing collar 16 and could also be provided with a protective foil 17 on top of the capsule 8 with its pyrophoric initiating charge. In such a case, the strength of the protective foil 17 is to be adapted in such a manner that it is blown to pieces when the oxygen is turned on. Both the protective foil and the sealing collar could of course also be used above water.

A further possible variant which is not actually illustrated in a figure is to assemble a lance part with an igniter to form a single unit. This variant could be appropriate when it is mainly a large number of very short lances intended for use with relatively short or long breaks between uses which is required. One possible such area of activity could be work on shipwrecks.

The invention claimed is:

1. An igniter suitable for igniting a thermal oxygen lance, the igniter comprising:

an ignition charge comprising a metal powder, a sleeve closed at one end thereof which encloses the ignition charge, wherein an inner diameter of the sleeve is greater than a mouth of the thermal oxygen lance;

a gas-permeable container; and an initiating charge comprising a pyrophoric metal powder arranged free-lying in the gas-permeable container, wherein the gas-permeable container is arranged in the sleeve between the mouth of the thermal oxygen lance and the ignition charge.

2. The igniter of claim 1, wherein the initiating charge comprises 0.05–0.5 g pure metallic powdered zirconium with a particle size of roughly 2–6 μm.

3. The igniter of claim 1, wherein the gas-permeable container comprises porous felt.

4. The igniter of claim 1, wherein the gas-permeable container comprises a porous felt cup having a fully covering cover made of a same felt material, wherein an inner volume of the cup is greater than a total volume of the pyrophoric metal powder.

5. The igniter of claim 1, wherein the ignition charge comprises a first fine-grained part charge and a second coarse-grained part charge, wherein each of these part charges comprise iron and aluminium in a weight ratio of 1:1.

6. The igniter of claim 1, wherein the ignition charge comprises a first fine-grained part charge containing iron powder with particles on the order of approximately 0.01 mm and aluminum particles on the order of approximately 0.1 mm, wherein a second coarse-grained part charge containing iron powder with particles on the order of approximately 0.4–0.8 mm and aluminum granules on the order of approximately 1–3 mm.

7. The igniter of claim 6 wherein the fine-grained part charge is arranged directly adjacent to the gas-permeable container in which the pyrophoric metal powder is arranged.

8. The igniter of claim 1, further comprising:

an outer tube part open at both ends and having an inner diameter greater than a diameter of the oxygen lance;

an inner sleeve completely closed at one end and fixed in said outer tube part by an upset indentation accommodated in a groove, wherein the ignition charge and initiating charge are each inserted into an inner sleeve having at least two guide tongues which guide and firmly hold the mouth of the oxygen lance directly above an inner duct of the sleeve;

a stop flange which limits an insertion of the oxygen lance into the inner sleeve to a position before it reaches the initiating charge; and a gas outflow opening which allows gas flowing out of the oxygen lance to flow out of a space directly above the initiating charge and back past the oxygen lance.

9. The igniter of claim 1, further comprising:

an elastic sealing collar surrounding an end facing the oxygen lance and the mouth of the oxygen lance; and a capsule with protective foil which covers the pyrophoric metal powder, wherein a strength of the protective foil is selected such that the protective foil is blown to pieces when oxygen is supplied to the oxygen lance.

wherein the elastic sealing collar and capsule are cooperatively arranged to allow the oxygen lance to operate underwater.

10. The igniter of claim 1, wherein the ignition charge comprises a mixture of iron and aluminium powder.

11. The igniter of claim 1, wherein the pyrophoric metal powder is selected from the group consisting of zirconium and titanium.

12. The igniter of claim 1, wherein the ignition charge is selected from the group consisting of iron and aluminum.

13. The igniter of claim 1, wherein the gas-permeable container is combustible.

14. A method of igniting an oxygen lance, the method comprising:

enclosing an ignition charge comprising a metal powder in a sleeve closed at one end thereof;

providing a gas-permeable container containing a pyrophoric initiating charge comprising a pure metal powder arranged free-lying therein;

supplying oxygen from the lance to a fine-grained pyrophoric metal powder which ignites on contact with the oxygen; and igniting the ignition charge from the ignited pyrophoric metal powder, wherein the ignited ignition charge and the ignited pyrophoric metal powder cooperate to ensure ignition of the oxygen lance.

* * * * *